United States Patent [19]

Baudin

[11] 4,415,322

[45] Nov. 15, 1983

[54] ROTARY MACHINE WITH CONTROLLED RETRACTABLE ELEMENTS

[75] Inventor: Lucien Baudin, Paris, France

[73] Assignee: IDRAM Engineering Company EST., Vaduz, Liechtenstein

[21] Appl. No.: 185,951

[22] Filed: Sep. 10, 1980

Related U.S. Application Data

[63] Continuation of Ser. No. 944,646, Sep. 21, 1978, abandoned.

[30] Foreign Application Priority Data

Feb. 10, 1978 [CH] Switzerland ..... 1523/78

[51] Int. Cl.[3] ..... F04C 29/10

[52] U.S. Cl. ..... 418/260; 418/262

[58] Field of Search ..... 418/125, 150, 260, 261, 418/262, 263, 264

[56] References Cited

U.S. PATENT DOCUMENTS

| | | | |
|---|---|---|---|
| 1,995,755 | 3/1935 | Smith . | |
| 3,040,974 | 6/1962 | Langdon | 418/261 X |
| 3,917,438 | 11/1975 | Glanvall | 418/150 |
| 4,118,160 | 10/1978 | Baudin | 418/260 |
| 4,133,617 | 1/1979 | Reynaud | 418/150 |

FOREIGN PATENT DOCUMENTS

| | | | |
|---|---|---|---|
| 51823 | 1/1912 | Austria . | |
| 533691 | 12/1954 | Belgium | 418/265 |
| 652128 | 12/1964 | Belgium . | |
| 2233145 | 1/1974 | Fed. Rep. of Germany . | |
| 2403011 | 7/1975 | Fed. Rep. of Germany . | |
| 2626449 | 12/1976 | Fed. Rep. of Germany | 418/265 |
| 866000 | 6/1941 | France | 418/265 |
| 2225053 | 10/1974 | France | 418/260 |
| 154615 | 2/1922 | United Kingdom | 418/265 |
| 1454329 | 11/1976 | United Kingdom . | |
| 1500619 | 2/1978 | United Kingdom . | |

*Primary Examiner*—Leonard E. Smith

*Attorney, Agent, or Firm*—Stevens, Davis, Miller & Mosher

[57] ABSTRACT

A rotor 10 rotates inside a stator 13 eccentric with respect to the rotor. Retractable elements 11 in the form of blades are mounted pivotably on the rotor. The blades cooperate with the internal surface of the stator. The machine is useful as a pump, compressor, etc. The region where the rotor 10 and the stator 13 are in permanent fluid-tight contact is recessed in the wall of the stator, in which the rotor is partly embedded. Thus fluid-tightness between the admission and the delivery is produced not along a tangent line, but throughout a sector Z. The blades are withdrawn during passage through the zone Z.

5 Claims, 8 Drawing Figures

ROTARY MACHINE WITH CONTROLLED RETRACTABLE ELEMENTS

This is a continuation of application Ser. No. 944,646 filed Sept. 21, 1978 (now abandoned).

FIELD OF THE INVENTION

The present invention relates to a rotary machine comprising a rotor, retractable elements mounted pivotably on the rotor, a stator inside which the rotor rotates with the retractable elements cooperating with the internal wall of the stator, and a control mechanism for the angular position of said elements with respect to their pivotal axis on the rotor. Such a machine is useful more particularly as a vacuum pump, volumetric pump or volumetric compressor.

BACKGROUND OF THE INVENTION

In principle, the known machines of this type comprise a stator having a cylindrical internal part of radius Rs and a rotor of generally cylindrical shape of radius Rr smaller than Rs. The rotor, which is eccentric with respect to the stator, is tangent internally to the stator. Fluid-tightness between the admission and the delivery is therefore produced only by a tangent line, which does not provide ideal fluid-tightness.

In some cases, a static scraper pressing against the rotor has been tried, but this device dissipates energy and does not achieve an appreciable improvement in the fluid-tightness.

Indeed, in order to achieve fluid-tightness, it would be necessary for said scraper to be machined across its total width to the diameter of the rotor. Now this is impossible because the blades would come and strike against it. Consequently the scraper must be machined to the diameter of the stator to permit the passage of the blades, which brings us back to a tangent line and does not solve the fluid-tightness problem.

OBJECTS OF THE INVENTION

The present invention has as its object to find a solution to this problem and to propose a machine in which fluid-tightness can be achieved over the extent of a sector and not only one line.

SUMMARY OF THE INVENTION

The rotary machine according to the invention, comprising a rotor, retractable elements mounted pivotably on the rotor, a stator inside which the rotor rotates with the retractable elements cooperating with the internal wall of the stator and a control mechanism for the angular position of said elements with respect to a pivotal axis on the rotor, is characterised by the fact that the rotor is, in one sector, embedded in a recess of the wall of the stator with which it cooperates to produce fluid-tightness.

Thus, the rotor being partially embedded in the stator, fluid-tightness between the admission port and the delivery port is produced perfectly by a contact between the rotor and the stator not along one generatrix only, but on an entire sector which can be generously dimensioned.

Of course, the embedding assumes that the retractable elements, generally blades, withdraw more deeply into the housing provided on the rotor for the duration of their passage through the sector, so as not to present any salient part with reference to a cylinder of radius Rr.

On the other hand, only this principle makes it possible to admit a scraper machine to the diameter of the rotor into its embedding. In this case, it is obviously necessary to prevent the possibility of the scraper entering a blade housing when the later appears in the zone Z (the sector in which the rotor is embedded as described) or at least, it is necessary to prevent the trailing edge of the housing from striking violently against the leading edge of the scraper, which might cause jamming and damage to the machine. To prevent this, it is sufficient to provide a scraper bearing upon a sector greater than the housing. But obviously the scraper must remain entirely within the zone Z.

The control mechanism for the orientation of the blades may be constructed in various ways. According to a first embodiment, the control mechanism comprises for each retractable element a lever integral with one end of the shaft of the element and, articulated to the lever, a connecting rod itself mounted pivotably coaxially to the stator. This mechanism produces a fully determined kinematic control of the pivoting of the retractable elements.

According to a second embodiment, the lever comprises a head cooperating, under the effect of centrifugal force, with an internal guide surface coaxial to the stator. The mechanism avoids the complication of the connecting rods, but is only suitable if the pressure exerted upon the blade develops a force weaker than the centrifugal force. It is by the effect of the centrifugal force that the head of the lever is required to adhere to the guide surface. It will be possible to conceive a force other than centrifugal force: the lever could also, for example, be urged by an elastic return means or a magnetic force.

In a third embodiment, derived from the previous one, the advantages of a complete kinematic control and of a simpler mechanism than a connecting rod/-lever combination are combined. Each element comprises, fixed to its shaft, a second lever fitted with a crank-pin cooperating with a guide surface coaxial to the stator, but radially external. The centrifugal force no longer acts to produce the cooperation of the lever heads with the first guide surface . Said second lever may be fixed either on the same side as the first lever, or on the opposite side.

BRIEF DESCRIPTION OF THE DRAWINGS

The invention will be better understood from reading the description of some embodiments given hereinbelow by way of example and with reference to the accompanying drawing, wherein.

DESCRIPTION OF THE PREFERRED EMBODIMENTS

Figure 1:
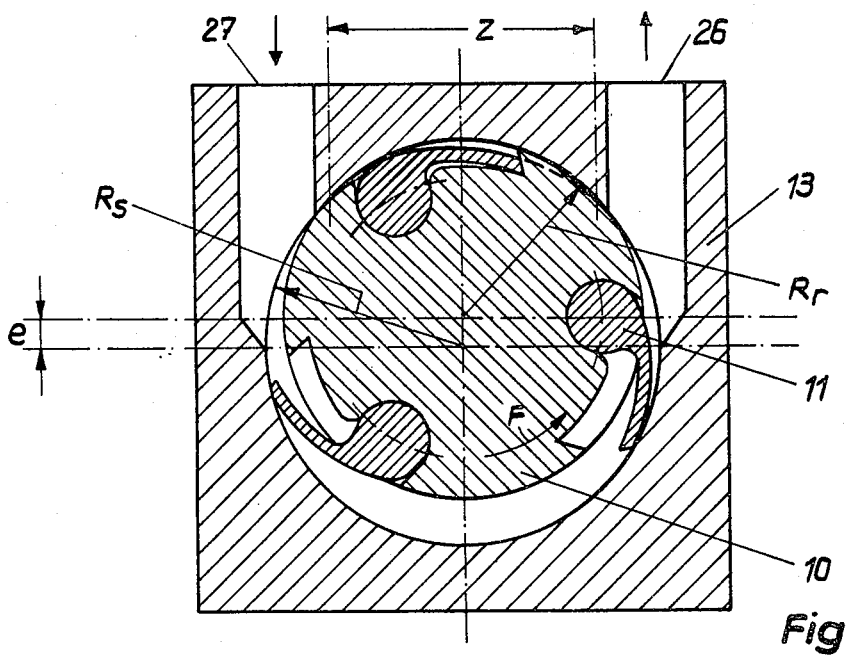
FIG. 1 shows in section an embodiment of the invention.

FIG. 1 illustrates in section a rotary machine in which the rotor 10 is partially embedded in the stator 13 in a zone Z separating the admission port 26 from the delivery port 27. The retractable elements are blades 11 connected to a control device not shown.

The rotor of radius Rr is eccentric with respect to the stator of radius Rs by a value e. If the rotor were simply tangent to the stator, this would mean $0<Rs-Rr=e$.

Here we have $0 \leqq Rs-<e$, which is to say that the cylinders intersect. The zone Z is precisely that determined by said intersection.

In this zone Z, the wall is machined to the diameter 2 Rr. A scraper machined to this diameter can therefore be arranged on the whole or a part of this zone.

Figure 2:
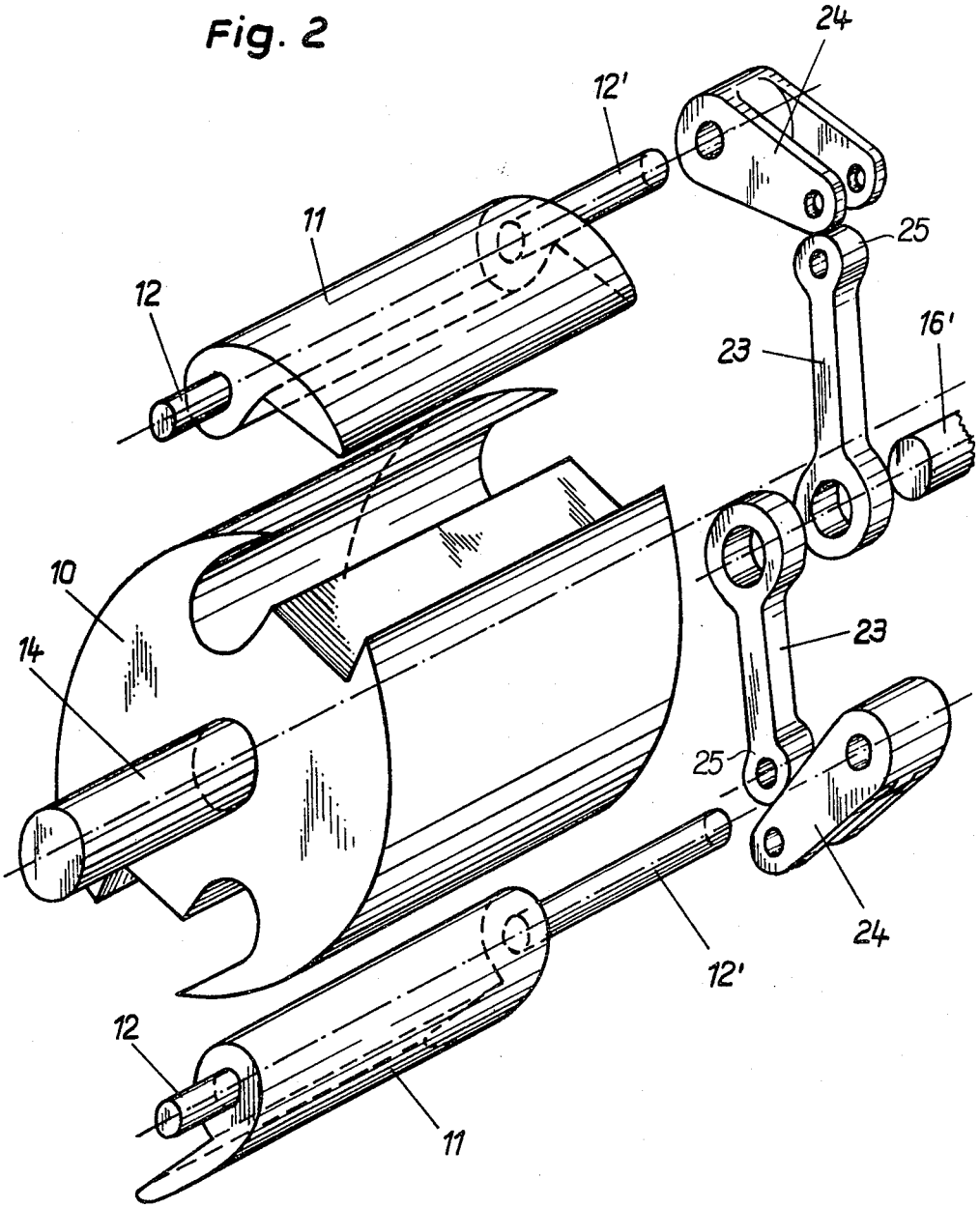
FIG. 2 shows, in exploded view, a rotor of an embodiment of the invention.

Several types of rotor may be suitable for this arrangement. FIG. 2 shows an exploded view of a rotor with two blades controlled by a set of connecting rods. The retractable blades are mounted pivotably about axes 12, 12'. It will be noted that said pivotal axes 12, 12' are parallel to the shaft 14 of the rotor 10 and that the axle portion 12' is longer than the portion 12.

The control mechanism of the retractable blades 11 comprises for each blade a connecting rod 23 swivelled at one end on the axle 16' integral with a cover forming part of the stator. The other end of the connecting rod 23 is articulated at 25 to a fork lever 24 keyed or otherwise fixed to the axle 12' of the blade 11.

It will be observed that the axis of articulation 25 of the connecting rod 23 with the lever 24 is located on the centre of curvature of the end of the blade 11.

The point of articulation describes a circle about the axle upon which the connecting rod is pivotably mounted. This circle is coaxial to the stator.

The functioning of the rotary machine described is as follows:- when the rotor 10 rotates, the rotary movement is communicated to the blades 11, the axles 12' of which in turn drive the levers 24 connected to the connecting rods 23. Due to the eccentricity of the axle 16' with respect to the axis of the rotor and to the definite length of the connecting rod 23, i.e. of the particular position of the articulation 25 of said connecting rod 23 to the lever 24 the blades 11 are pivoted about their axles 12, 12' so that the end of each blade 11 moves tangentially to a cylindrical surface concentric to the axis 16' coinciding with the internal surface of the stator 13, except for the zone Z (the stator is not shown in FIG. 2).

In the case of a compressor, for example, when the rotor 10 rotates in the direction of the arrow F (FIG. 1), a certain volume of fluid is sucked through the admission port 27. This volume of fluid is then transported in the space included between two successive blades 11 and pumped through the delivery port 26 thus ending the cycle.

Figure 3:
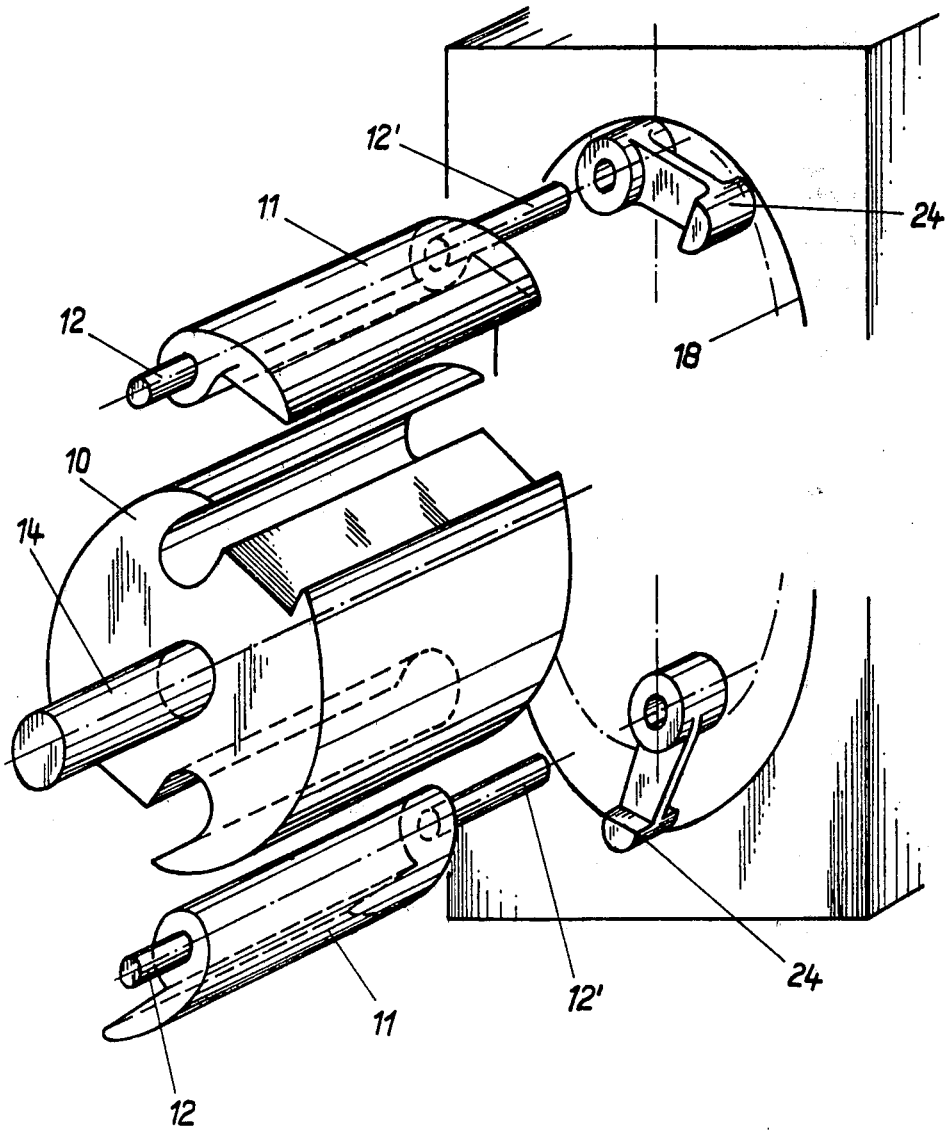
FIG. 3 shows, in exploded view, the rotor of another embodiment of the invention.

FIG. 3 illustrates another type of rotor, likewise shown in exploded view.

The control mechanism of the retractable blades 11 comprises for each blade a lever fixed to the end 12' of the axle of the blade. The lever comprises a head 24 intended to cooperate with the guide crown 18.

During the functioning of the machine, the rotor 10 rotates in the direction of the arrow F. This rotary-movement is communicated to the blades 11, the axles 12' of which in turn drive the arms 24 which, by the action of centrifugal force, adhere to an internal guide surface 18 so that the end of each blade 11 moves tangentially to a cylindrical surface coaxial to said surface 18. As in the case of FIG. 2, this cylindrical surface coincides with the internal surface of the stator except for the zone Z (the stator itself is not shown in FIG. 3).

As to the guide surface 18, this is an internal surface of revolution, likewise coaxial to the stator (except the zone Z of course). If the head 24 exhibits a cylindrical surface of cooperation with axis parallel to the axis of the machine, the said surface of revolution 18 may be cylindrical and this will be the most frequent case.

In the variant of FIG. 2, the connecting rod/lever articulation describes a circle about the eccentric axle upon which the other end of the connecting rod is pivotably mounted. This is a kinematically determined trajectory.

In the variant of FIG. 3, there is likewise a point of the lever, the head 24, which describes a circle about the eccentric axis, so that the trajectory is the same, but determined by the combination of a kinetic effect which is centrifugal force and a kinematic limitation, determined by the surface of revolution 18. The advantage lies in the fact that the control mechanism is simpler.

Such a mechanism is suitable for the case where the pressure exerted by the fluid upon the blades creates a force weaker than the centrifugal force.

FIGS. 4 to 7 illustrate another embodiment. The particular nature of the partial embedding (Z) of the rotor in the stator is clearly shown in FIG. 5. Also, this embodiment comprises a control mechanism of intermediate conception between those of the two previous examples described, and combines their respective advantages in one novel and advantageous solution.

Figure 4:
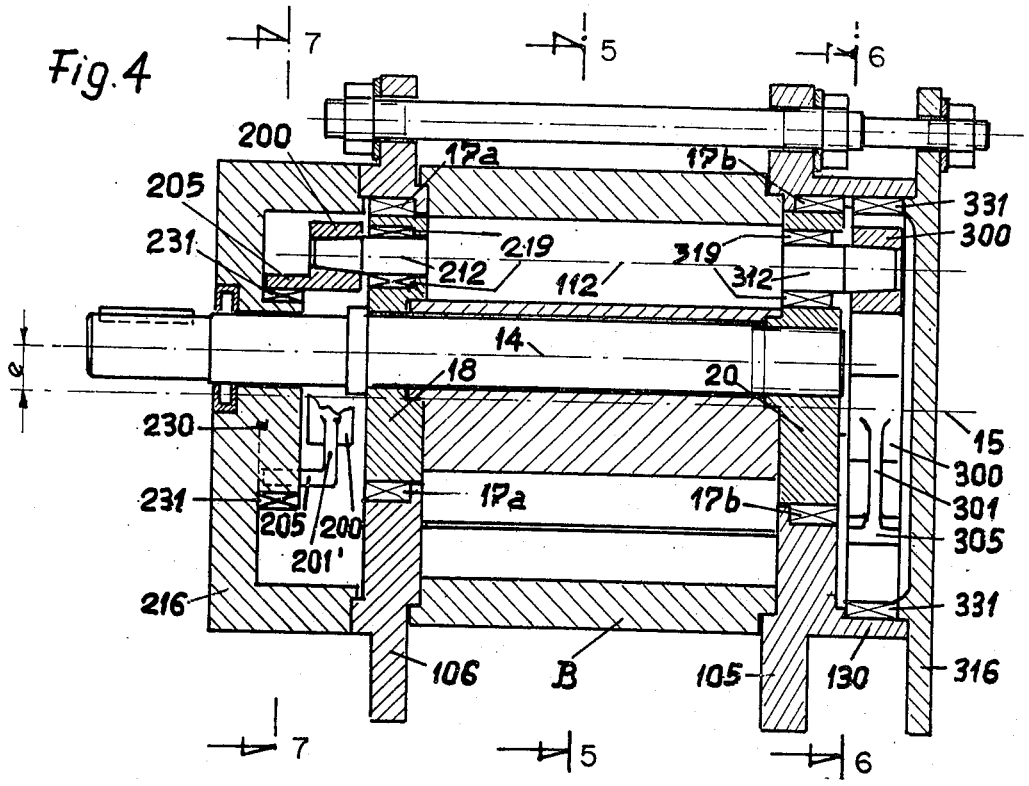
FIG. 4 shows another embodiment in a longitudinal section made along A—A in Fig. 5, FIGS. 5, 6 and 7 illustrate different sections transverse to the axis of the machine of FIG. 4, made along B—B, C—C, and D—D respectively of FIG. 4.
Figure 5:
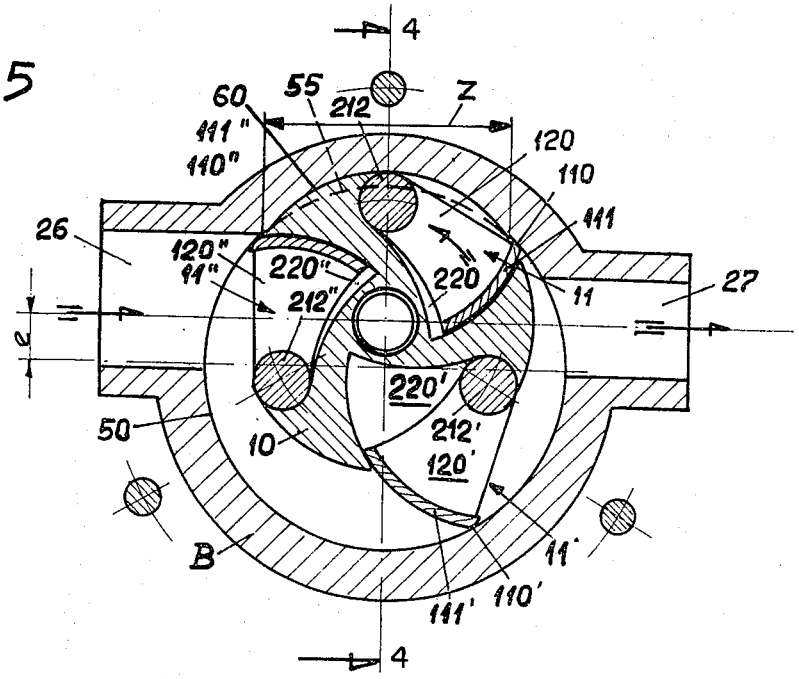
Figure 6:
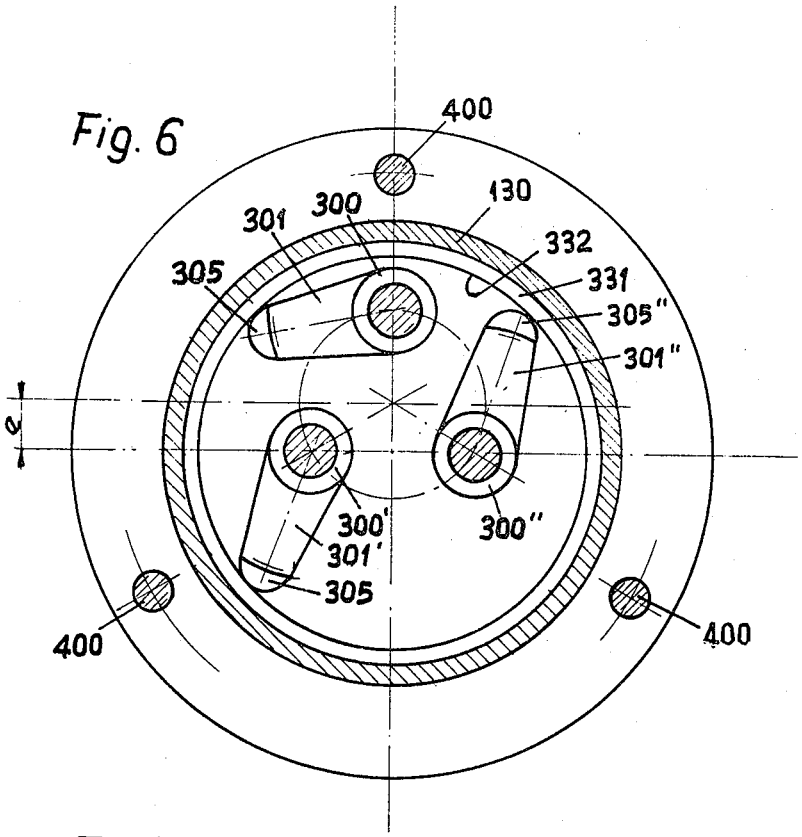
Figure 7:
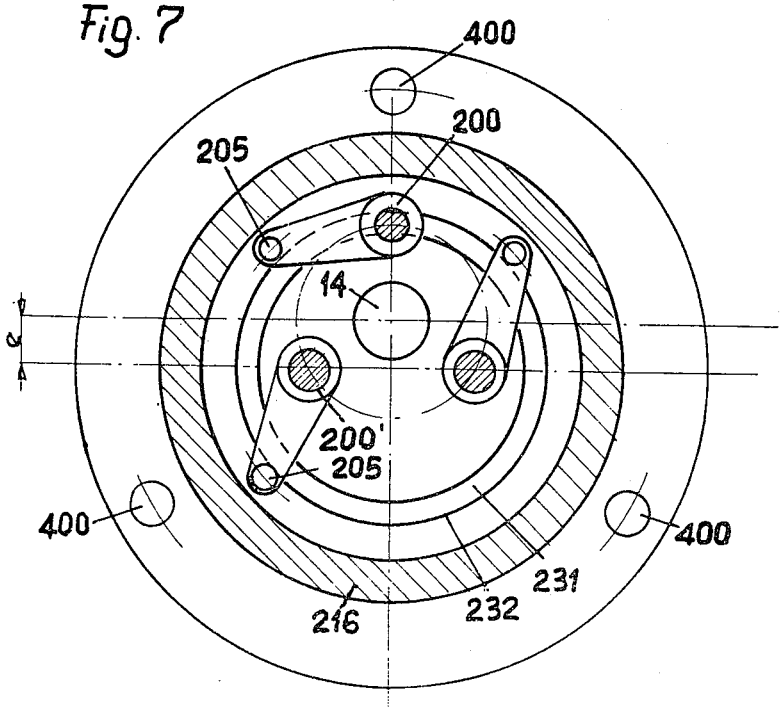

FIG. 4 illustrates a longitudinal section of the machine. FIGS. 5, 6, and 7 show different cross-sections of the machine.

The machine comprises a rotor 10 equipped with three retractable elements 11, 11', 11''. For each retractable element, the rotor comprises a housing 220, 220', 220'' respectively.

The retractable elements are similar and homologous elements so that it is sufficient to describe only one of these elements.

As FIG. 5 shows particularly, the element 11 comprises a blade 111, of which an edge 110 cooperates with the internal cylindrical surface 50 of the stator 13, except of course for the zone Z.

The element 11 also comprises a rotary axle 112 and an element 120 attaching the blade 110 to the axle 112, the housing 220 is provided in the rotor for the withdrawal of the element 11.

The axle 112 has two ends 212 and 312 pivoted in the respective bearings 219, 319 made in the respective end flanges 18, 20 of the rotor, as shown in FIG. 4.

The stator comprises end flanges 105 and 106. The rotor flange 18 is mounted for rotation in the stator flange 106 through the intermediary of the bearing **17*a*, and similarly the rotor flange 20 is mounted for rotation in the stator flange 105 through the intermediary of the bearing 17*b***, thus effecting the assembly of the rotor in the stator.

The rotor 10 has a shaft 14 permitting motive energy to be supplied to the machine when it is used, e.g. as a compressor.

FIGS. 6 and 7 illustrate the control mechanism of the pivoting of the retractable elements.

As FIGS. 4 and 6 show, the end 312 of the axle 112 of the element 11 is integral with a lever comprising a shank 300 fixed to the axle end 312; the shank 300 is prolonged by an arm 301 terminating in a head 305 intended to cooperate with the internal surface 332 of a ring 331. The ring 331 is concentric with the stator and is housed in an external crown 130 integral with the stator flange 105.

This arrangement would be sufficient to guide the movement of the oxcillating elements if a sufficient centrifugal force existed, ensuring that the retractable elements always have a tendency to emerge from their housing, so that the head 305 of the lever 301 bears upon the surface 332 and likewise, it need hardly be said, for the heads 305', 305''.

As has been stated with reference to FIG. 3, this assembly has the advantage of simplicity, because it avoids the necessity of attaching the head of each lever to a connecting rod which would be pivoted at its other end about an axis concentric with the stator.

But if the centrifugal force is insufficient, then this assembly is unsatisfactory; on the other hand, the solution proposed here permits a satisfactory function even without the centrifugal force, and yet even without returning to the relatively complicated system of the connecting rod/lever combination.

The solution lies in an arrangement provided and illustrated here at the other end of the machine, as FIGS. 4 and 7 show.

The axle 112 is prolonged by the end 212, upon which is mounted a lever comprising a shank 200 prolonged by an arm 201 terminated by a crank-pin 205 extending at right-angles to the arm 201 and parallel to the axis of the machine. Said crank-pin 205 cooperates with the external surface 232 of a ring 231. The ring 231 is concentric with the stator and it is mounted in a cover 216 fixed to the stator flange 106. The ring is mounted on an internal protuberance 230 of the cover 216.

As will be seen, the arrangement provided at the end of the machine on the left-hand side in FIG. 4 resembles the arrangement on the right-hand side, except that the surface 232 is the external surface of a ring whereas the surface 332 is the internal surface of a ring.

In combination, these two arrangements, which can be adjusted easily and independently, therefore, produce a kinematic guidance of the oscillating movement of the elements 11, 11', and 11'' which is completely determined as a function of the rotation of the rotor in the stator, although it does not involve the connecting rod/lever combination.

When the element 11 passes through the zone Z, it will be noticed, as shown in FIG. 5, that the edge 110 of the blade 11 moves along the trajectory 55 which is the prolongation of the interior circular contour 50 of the stator. However, the rotor cooperates with a recessed portion 60 machined practically to the same diameter as the rotor, which produces fluid-tightness between the upstream part and the downstream part of the machine in a highly efficacious manner.

Figure 8:
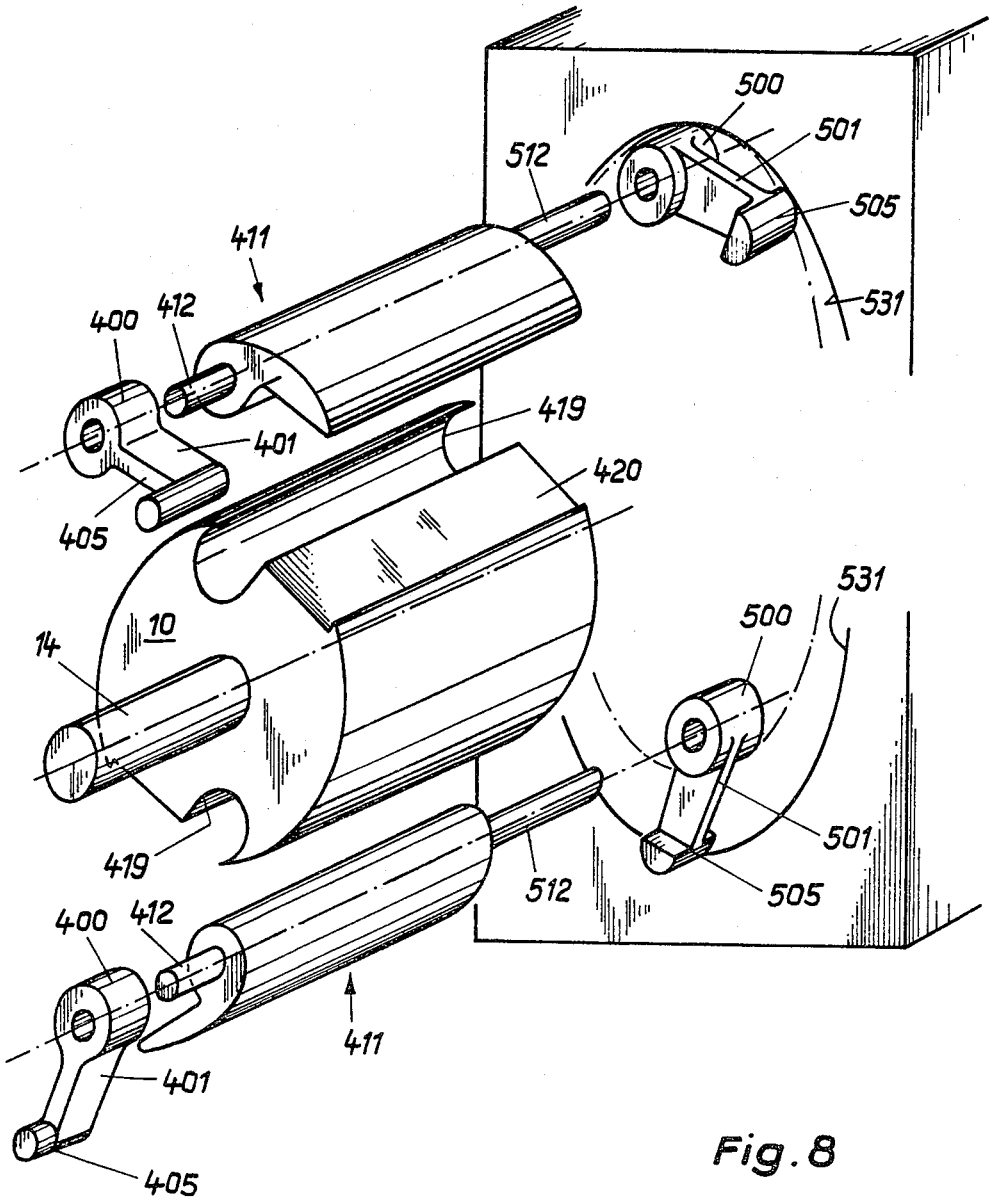
FIG. 8 shows in exploded view a rotor of an embodiment similar to that of FIG. 4.

FIG. 8 illustrates in an exploded view the rotor of another embodiment of the invention. This embodiment is very similar to that described with reference to FIGS. 4 to 7, with the exception that the rotor comprises two retractable elements instead of three, and that the shape of the blades is different.

The two types of levers will be noticed, on the one hand the levers 501 on the right-hand side of the figure, fitted with a head 505 cooperating with an internal cylindrical surface 531 concentric with the stator, and on the other hand the levers 401, on the left-hand side of the figure, fitted with crank-pins 405 intended to cooperate with an external cylindrical surface (not shown) concentric with the stator.

I claim:

1. A rotary machine, comprising:

a stator having a rotor chamber, two lateral parts, an outer casing, a fluid inlet to said rotor chamber and a fluid outlet from said rotor chamber; said rotor chamber comprising a first part-cylindrical recess and a second part-cylindrical recess which intersects said first part-cylindrical recess and has a radius greater than that of said first part-cylindrical recess; the axis of said first part-cylindrical recess being substantially parallel to and spaced from the axis of said second part-cylindrical recess, the sum of the radius of said first part-cylindrical recess and the distance between the axes of said first and second part-cylindrical recesses being greater than the radius of said second part-cylindrical recess; said fluid inlet being adjacent one extremity of said first part-cylindrical recess and said fluid outlet being adjacent the other extremity of said first part-cylindrical recess;

a cylindrical rotor rotatably secured in said rotor chamber, having a radius substantially equal to that of said first part-cylindrical recess, the axis of said rotor substantially coinciding with the axis of said first part-cylindrical recess;

a plurality of cavities in the surface of said rotor;

a plurality of blades pivotably mounted in the cavities of said rotor, having a length so as to be able to extend a distance from the rotor surface at least equal to the sum of: the difference between the radii of said first and second part-cylindrical recesses, and the distance between the axes of said first and second part-cylindrical recesses; the depth of said cavities being at least equal to the thickness of said blades; the depth of said cavities at the tips of said blades being at least as great as the difference between: the sum of the radius of said rotor and the distance between the axes of said first and second part-cylindrical recesses, and the radius of said second part-cylindrical recess;

smooth, continuous, control means attached to said blades for controlling the pivotal movement of said blades with respect to the rotor so that the tips of said blades travel in a circular path having a radius equal to that of said second part-cylindrical recess and having an axis coinciding with that of said second part-cylindrical recess;

fluid-tight moving compartments defined by said blades and said second part-cylindrical recess, said blades dividing the space between said second part-cylindrical recess and said rotor into said moving compartments with no significant dead space;

the surface of said rotor contacting said first part-cyclindrical recess to provide a zone of fluid tightness along said first part-cylindrical recess, the tips of said blades being spaced from said first part-cylindrical recess.

2. A rotary machine according to claim 1, wherein the control mechanism comprises for each blade a lever defining the pivotal position of said blade and a connecting rod, articulated to the lever on one side and to the stator on the other side, the stator axis being also the axis of this second articulation.

3. A rotary machine according to claim 1, wherein said control mechanism comprises an internal surface guiding path provided on one of said lateral parts, each of said blades being linked in its pivotal movement through a lever, whose head is guided by said internal surface guiding path.

4. A rotary machine according to claim 3, wherein said control mechanism further comprises an external surface guiding path on one of said lateral parts, each blade being linked in its pivotal move through a lever to said external surface guiding path.

5. A rotary machine according to claim 4, wherein said internal and external guiding paths are respectively provided on opposite lateral parts.

* * * * *